United States Patent [19]

Bulla et al.

[11] 4,308,640

[45] Jan. 5, 1982

[54] CROSS LAPPING APPARATUS

[75] Inventors: Jackie N. Bulla; Billy B. Fesperman, both of Charlotte, N.C.

[73] Assignee: Celanese Corporation, New York, N.Y.

[21] Appl. No.: 18,648

[22] Filed: Mar. 8, 1979

[51] Int. Cl.[3] ..... D04H 11/04

[52] U.S. Cl. ..... 19/163

[58] Field of Search ..... 19/65 CR, 159 R, 161.1, 19/163

[56] References Cited

U.S. PATENT DOCUMENTS

| | | | |
|---|---|---|---|
| 3,222,730 | 12/1965 | Kalwaites | 19/163 |
| 3,485,428 | 12/1969 | Jackson | 19/163 X |
| 3,903,569 | 9/1975 | Brandis | 19/163 |
| 4,003,104 | 1/1977 | Gunter | 19/159 R |
| 4,074,395 | 2/1978 | Frosch et al. | 19/163 |
| 4,194,270 | 3/1980 | Hille | 19/163 |

*Primary Examiner*—Louis Rimrodt

*Attorney, Agent, or Firm*—Robert J. Blanke

[57] ABSTRACT

A high speed cross-lapping apparatus is disclosed which forms batting from a high total denier tow of continuous filament material such as polyester. The apparatus includes a reciprocating carriage having a pair of steel rolls which deliver the tow to an underlying receiving conveyor. To drive the carriage, either a unidirectionally driven belt or a reversible electric motor may be provided. Inertia reversal apparatus including a pneumatic cylinder is located at each end of the carriage stroke. To accomodate differences in tow length as the carriage reciprocates, a horizontally disposed length compensating assembly is employed.

5 Claims, 14 Drawing Figures

CROSS LAPPING APPARATUS

BACKGROUND OF THE INVENTION

The present invention relates generally to apparatus for cross-lapping a textile material in order to form a batting of indefinite length. More particularly, the present invention concerns apparatus for making a batting from a high denier tow of substantially continuous filaments.

In the past, cross-lapping devices have been developed in order to form a batting of staple fibers. By virtue of the relatively short length of staple fibers, the material must be vertically supported throughout processing and particularly during lay down in order to avoid tension that may cause separation, or otherwise render the material unfit for use in cross-lapping process and apparatus. In fact, these cross-lapping devices have been developed for accomodating the idiosyncrasies of staple fiber material and are unsuited to use for continuous filament materials.

When dealing with continuous filament materials, such apparatus is, therefore, unnecessarily complex and consequently expensive. One aspect of the unnecessary complexity is that a substantially continuous filament material in the form of a high denier tow is capable of self support during essentially horizontal runs. Thus, vertical support for the tow is not necessary. Another aspect of handling continuous synthetic filaments concerns the development of static electricity during processing. For example, when static charges accumulate on the filaments, the individual filaments repel one another making it difficult to deposit the filaments in a controlled manner.

There exists a cross-lapping device for continuous filament material which employs an arcuately swinging chamber which directs the material to a conveyor. But, where the chamber itself experiences arcuate movement, the tow of continuous filament material is cast at the receiving surface with varying unsheltered length and variable tension. Casting in that device also uses air currents to aid placement of filament material as it is being deposited. These air currents and tensile strength variations make a difficult task in obtaining a uniform density batting with precision edges. Where material lay down adjacent the batting edges does not provide a straight precision edge, some further processing of the batting is required in order to provide an acceptable product for subsequent use.

One cross-lapping device, has made use of a reciprocating carriage disposed transversely above a receiving conveyor, with the carriage having a pair of counter rotating rolls: one roll being resiliently surfaced, the other being steel. It has been found, however, that this combination of two dissimilar materials for the processing carriage generates static electricity in the tow of continuous filament material causing difficulty in subsequent lay down during batting formation. Moreover, the filament material tends to adhere to the surface of the resilient roll and to become wrapped therearound. This wrapping phenomenon is commonly referred to as lapping. When lapping occurs, the throughput rate of tow is limited and, when lapping continues, machine must be shut down so as to clear the roll. Accordingly, a device which overcomes the combined problems of static electricity and lapping is a desirable improvement in the art.

Another difficulty encountered in connection with the known cross-lapping machines having a reciprocating carriage relates to the mech nism for effecting carriage reversals. The inertia of the carriage is an important factor in determining the speed and ease with which the reversals may be effected. Accordingly, it is important to have a carriage which is as light as possible so as to provide a minimum inertia that must be reversed at the end of each reciprocating stroke. In this connection, it is desirable to have a reversible drive system in continuously driving relationship to the carriage so that carriage motion can be controlled throughout the stroke and delays in starting movement are minimized. Such a device is to be sought since it can contribute to the increase in effective material feed rate and, simultaneously, provide both the uniform density and a rigidly controlled precision edge for the batting.

In view of the foregoing discussion, it will be apparent to those skilled in the art that the need continues to exist for a cross-lapping mechanism which overcomes the problems of the type discussed.

SUMMARY OF THE INVENTION

The diffenciencies discussed above as well as many others are overcome by a cross-lapping machine which includes a conveyor assembly for receiving the formed batting material, a frame, a carriage reciprocally mounted upon the frame for movement transversely of the conveyor and operable to deposit a tow of high denier continuous filament material on the conveyor such that successive layers of the continuous filamentry material are displaced longitudinally relative to adjacent layers of filament material in the batting. In addition, the apparatus is provided with a pair of counter rotating metal rolls which extend transversely of the carriage and have a nip through which the tow of continuous filament material passes so as to be positively driven toward the underlying receiving conveyor. In this manner, lapping of the feed rolls is avoided and generation of static electricity in the tow material by the drive rolls is also reduced. By avoiding these features, it is possible to operate a cross-lapper at a substantially increased operating speed and to handle a tow with substantially increased total denier. Accordingly, the selection of materials for the drive rolls is particularly important.

In order to improve upon the rate at which a tow of continuous filament material can be deposited on the receiving conveyor, it is necessary to exert precise and defined control in the operation of the cross-lapping machine. To this end, a reversable motor may be provided in conjunction with means for connecting the reversable motor to the carriage. With such an arrangement, movement of the carriage transversely of the receiving conveyor can be precisely defined and controlled to stay within indentified limits. As a result, the edge of the material develops with a high level of precision. At the same time the tow input rate can be increased.

The use of reversing cylinders to provide deceleration to stop, and to assist acceleration in opposite directions is very important. Combinations of reversing cylinder strokes and reversing cylinder back pressure can be used to alter edge density in the batting if desired. In addition, the batting edge build-up may be wholly or partially controlled by means of an electronic control system for the reversable motor.

BRIEF DESCRIPTION OF THE DRAWINGS

Many objects of the present invention will be apparent to those skilled in the art when this specification is read to conjunction with the drawings wherein like reference numerals has been applied to like elements and wherein.

Figures 2, 3:
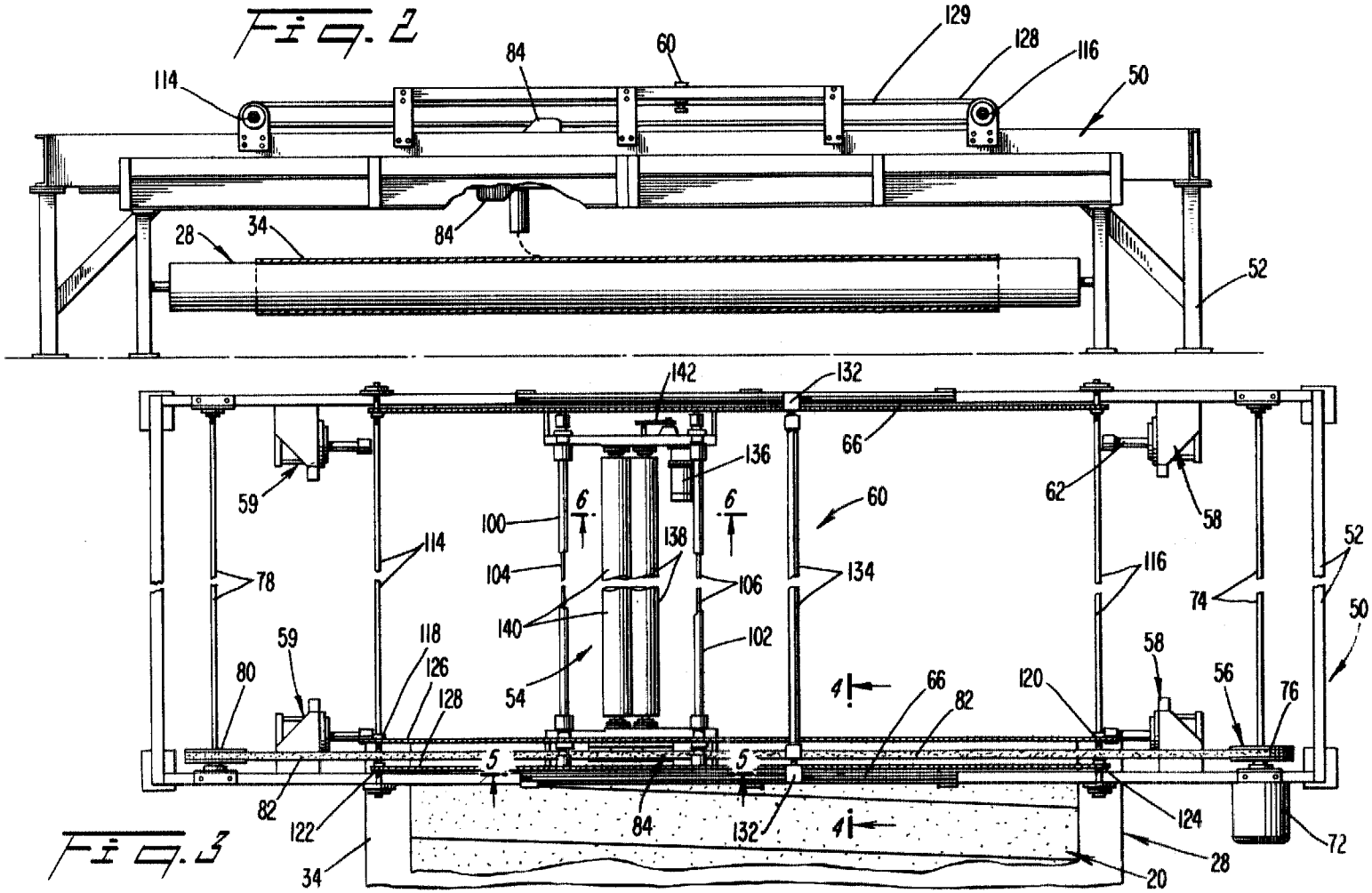
FIG. 2 is a front elevation of a cross-lapping machine suitable to generate a batting as shown in FIG. 1, a portion of the machine being removed in the interest of clarity.
FIG. 3 is a plan view of the machine in FIG. 2 with portions removed for clarity.
Figure 8:
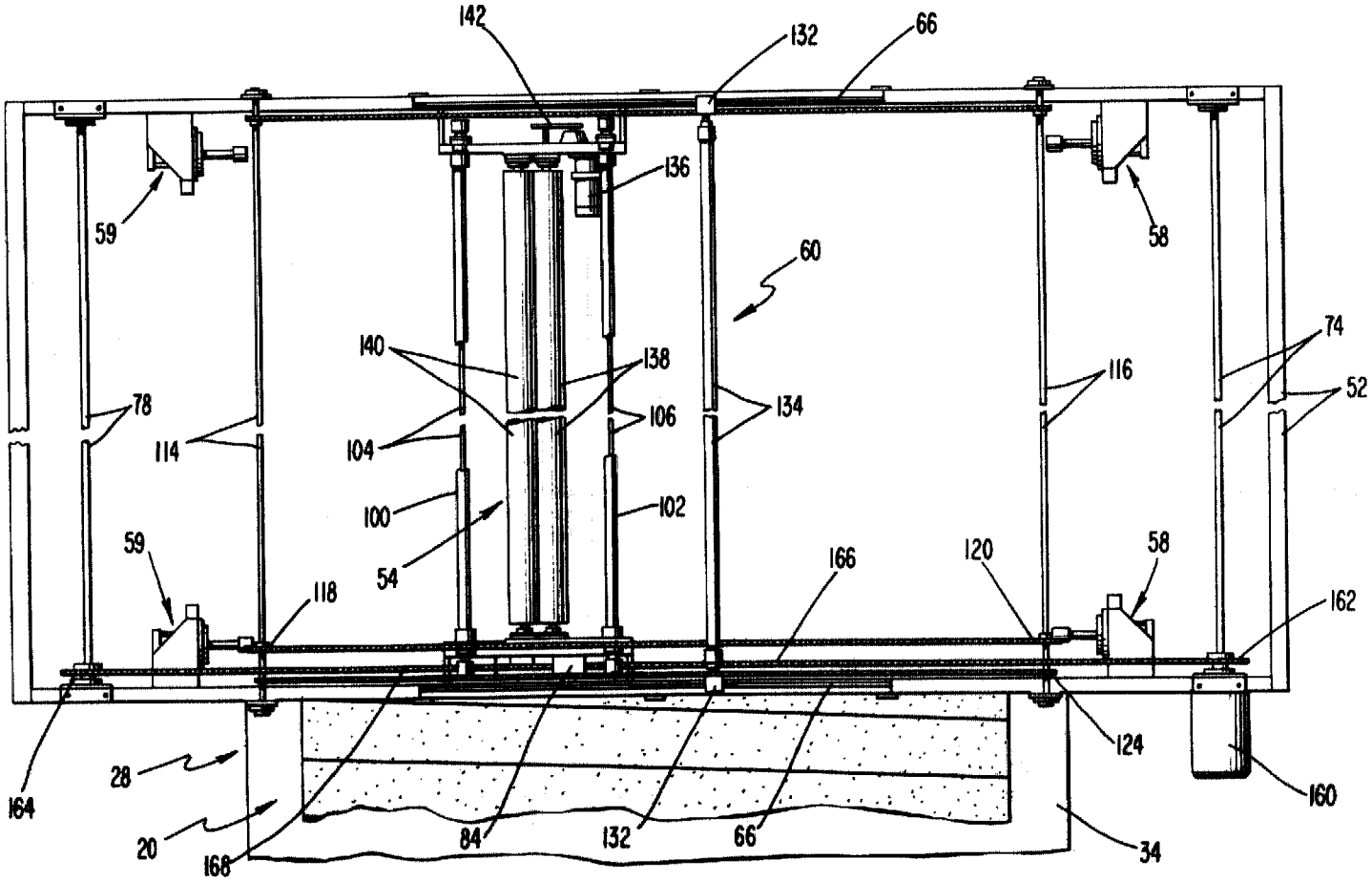
Figure 9:
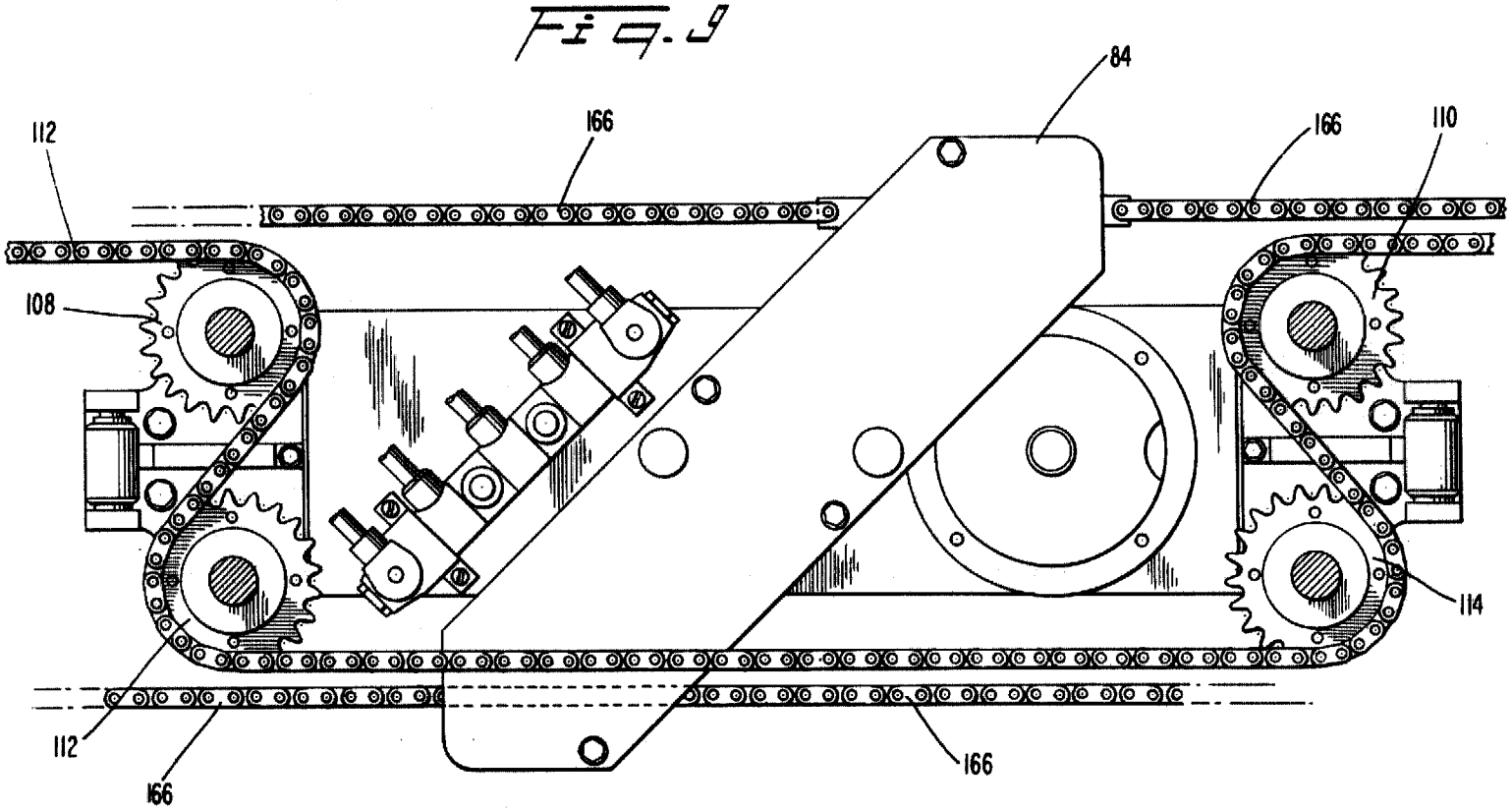

FIGS. *6a* and *6b* are detail views of alternate embodiments for the bottom of the chute;

FIGS. *7a–7d* are schematic views illustrating a sequence of steps in the reciprocating movement of the carriage and the associated compensating roll;

FIG. 8 is a plan view similar to FIG. 3 showing a second embodiment of the present invention with an alternate directly driven reversible drive system; and FIG. 9 is an enlarged partial cross-sectional view taken along 9—9 of FIG. 8.

DESCRIPTION OF THE PREFERRED EMBODIMENTS

Figure 1:
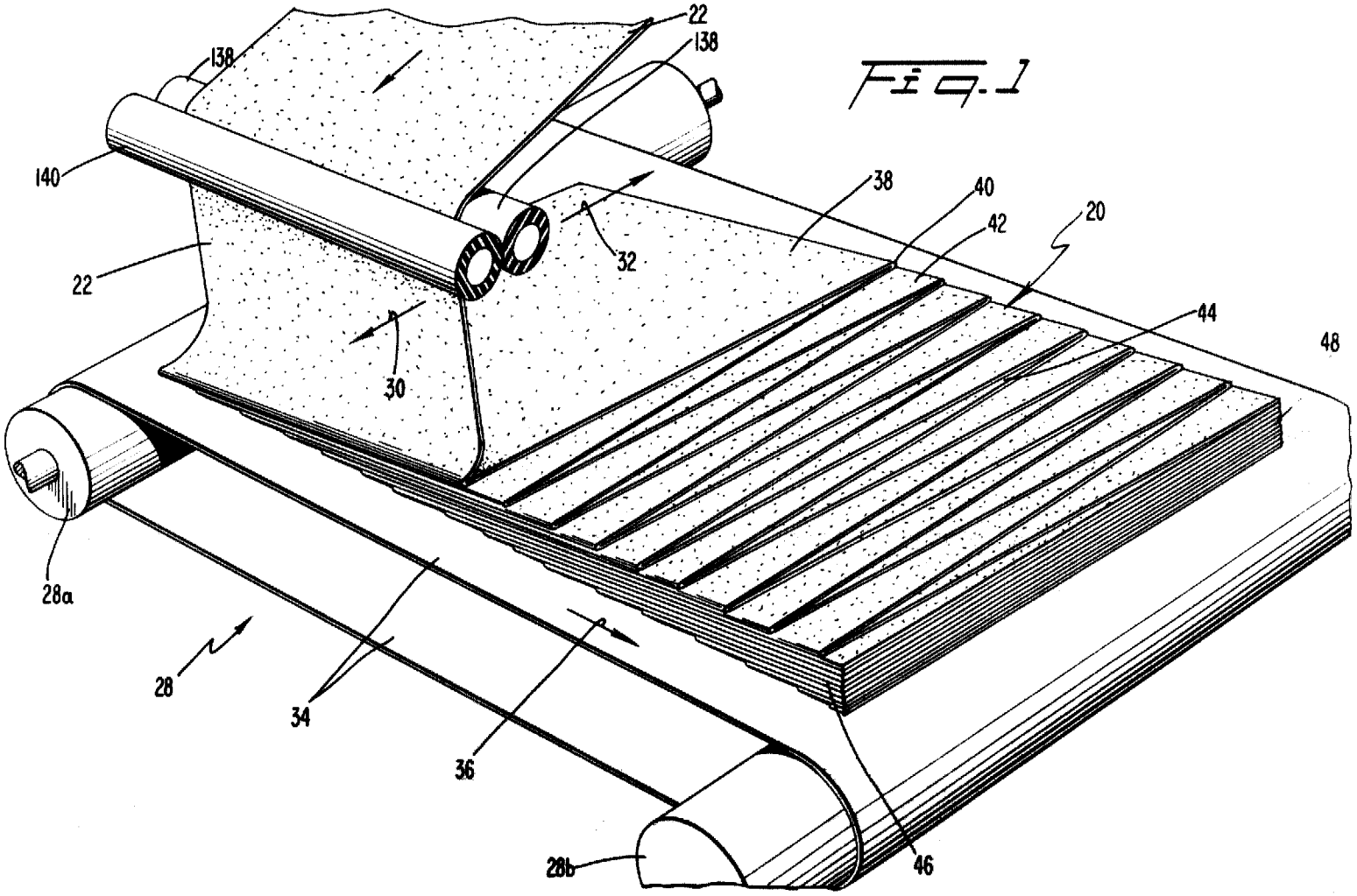
FIG. 1 is a schematic perspective view of a cross-lapped batting of the type manufactured in accordance with the teachings of the machine of the present invention.

Turning now to FIG. 1, a batting 20 of the type fabricated by the cross-lapping apparatus of the present invention is illustrated. The batting 20 is fabricated from a tow 22 having a multiplicity of individual essentially continuous filaments therein. The material from which the filaments is fashioned may comprise any suitable synthetic material including polyesters. The individual filaments are preferably crimped before being supplied as a tow. Generally speaking, the total denier of the tow may be on the order of 450,000. With a tow of such high denier, the lateral width of the tow as it enters the nip of the schematically illustrated drive rolls 138, 140 can have a significant lateral width. For example, the lateral width of the tow may be spread to a dimension on the order of 3 to 6 feet or greater.

As the tow of continuous filamentry material passes through the nip of the rolls 138, 140, the rolls 138, 140 are caused to traverse an underlying conveyor means 28 alternately in the direction of the arrows 30, 32. With the conveyor means 28 being driven such that its upper run 34 moves in the direction of the arrow 36, the tow of filament material 22 is deposited on the upper run 34 in a series of uniformly spaced substantially overlapping layers 38, 40, 42, 44 and so on as the rolls 138, 140 traverse the conveyor.

It will be observed from FIG. 1 that the lateral edges 46, 48 of the tow 20 are very precisely defined: i.e., there is little deviation from a straight line at the edge of the batting. With precise definition of the lateral edges 46, 48 material waste in the batting is substantially reduced as compared with presently available devices. In distinction, edge control of the earlier devices was random, at best, such that the batting required subsequent trimming to provide a product having a straight useful edge.

Depending upon the nature of the filament material being cross-lapped and upon the use for which the batting 20 is made, additional treatment of the batting contemporaneously with the cross-lapping may be desirable. For example, a web may be placed upon the upper run 34 of the conveyor 28 prior to depositing the tow as a cross-lapped batting 20. Such an addition may be useful in situations where the individual filaments have a tendency to adhere to the material from which the upper run 34 of the conveyor is constructed.

Another possible treatment is to apply a web to the top of the cross-lapped batting 20 at a position on the conveyor 28 after the batting has been formed. When such an upper cover is applied to the batting, the batting is more easily rolled for subsequent handling and/or treatment. The underlying and overlying webs may be used alternately or in combination with one another.

Another possible treatment is to provide one or more splitter discs (or rotary knives) which longitudinally slit the batting 20 to provide a two or more battings of narrower width.

Turning now to FIG. 2, the orientation of the receiving conveyor 28 relative to the cross-lapping apparatus 50 is more readily seen. The receiving conveyor 28 is positioned such that the upper run 34 of the conveyor 28 is positioned directly beneath the traversing apparatus of the cross-lapping apparatus 50. In addition, the receiving conveyor 28 may be partially supported by a portion of the frame 52 of the cross-lapping apparatus 50. The conveyor 28 has a width at least as long as the stroke through which the cross-lapping apparatus deposits a tow. Preferably, conveyor 28 is positioned at a shallow angle from the horizontal, with roll member **28*a* being elevated relative to roll member 28*b* whereby the distance from the nip of rolls 138, 140 to the batting layer 38 is constant across the width of web 22**.

The cross-lapping apparatus 50 (see FIG. 3) includes a carriage means 54 which reciprocates through a stroke length between the ends of the frame 52. The stroke is transverse and essentially perpendicular to the underlying receiving conveyor 28. In addition, the carriage means 54 supplies the tow of continuous filament material to the receiving conveyor 28 at a predetermined controlled velocity. By regulating the delivery velocity such that it is constant, and by moving the carriage means 54 at a uniform velocity transversely of the underlying receiving conveyor 28, the batting produced by the cross-lapping apparatus 50 is substantially improved and is characterized by a uniform density.

The cross-lapping apparatus 50 is also provided with a drive means 56 for moving the carriage means 54 from one end of the frame 52 to the other end thereof through the stroke. Reversals of movement for the carriage means 54 are facilitated by the presence of a pair of inertia reversal means 58 and 59 positioned at each end of the frame 52. These inertia reversal means 58 both absorb the inertia of movement associated with the traversing carriage means 54 and utilize this absorbed inertia to help start the carriage means 54 along a stroke in the reverse direction.

Another feature of the cross-lapping apparatus 50 is a compensating means 60 around which the tow passes before reaching the carriage means 54. By coordinating movement of the compensating means 60 with movement of the main carriage means 54, the tow can be supplied to the cross-lapping apparatus 50 at a uniform linear velocity and can be deposited at a uniform velocity by the carriage means 54 onto the conveyor 28 while maintaining a uniform tension in the material despite the reciprocating movement of the carriage means 54.

The reciprocating stroke of the carriage means 54 is a straight line that extends between the inertia reversal means 58, 59 at opposite ends of the frame 52. Moreover, the stroke is adjustable by positioning the location of the inertia reversal means 58, 59 and by compensating control of the drive means 56. Each inertia reversal means 58, 59 may, for example, comprise a pneumatic cylinder which is provided with a predetermined backpressure. As the carriage means 54 initially engages the inertia reversal means 58 at the end of the stroke, a plunger 62 in each of the two laterally spaced inertia reversal means 58 is engaged thereby. At this point, the carriage 54 may be disconnected from the drive means 56. Continued movement of the carriage means 54 displaces the extended plunger 62 increasing internal pressure in the pneumatic cylinder. This pressure increase provides an increasing resistance to movement of the carriage means 54 until the carriage means 54 finally comes to a complete stop. When the carriage stops, the existing high pressure within the inertia reversal means 58 pushes the plunger 62 out. This extension of the plungers 62 operates to start moving the carriage means 54 in the direction away from the cylinders. Thus, the pneumatic cylinders function in the fashion of a spring or a gas spring.

At the other end of the frame 52 the second pair inertia reversal means 59 cooperates to reverse direction of carriage movement at the end of the reverse stroke.

Figure 4:
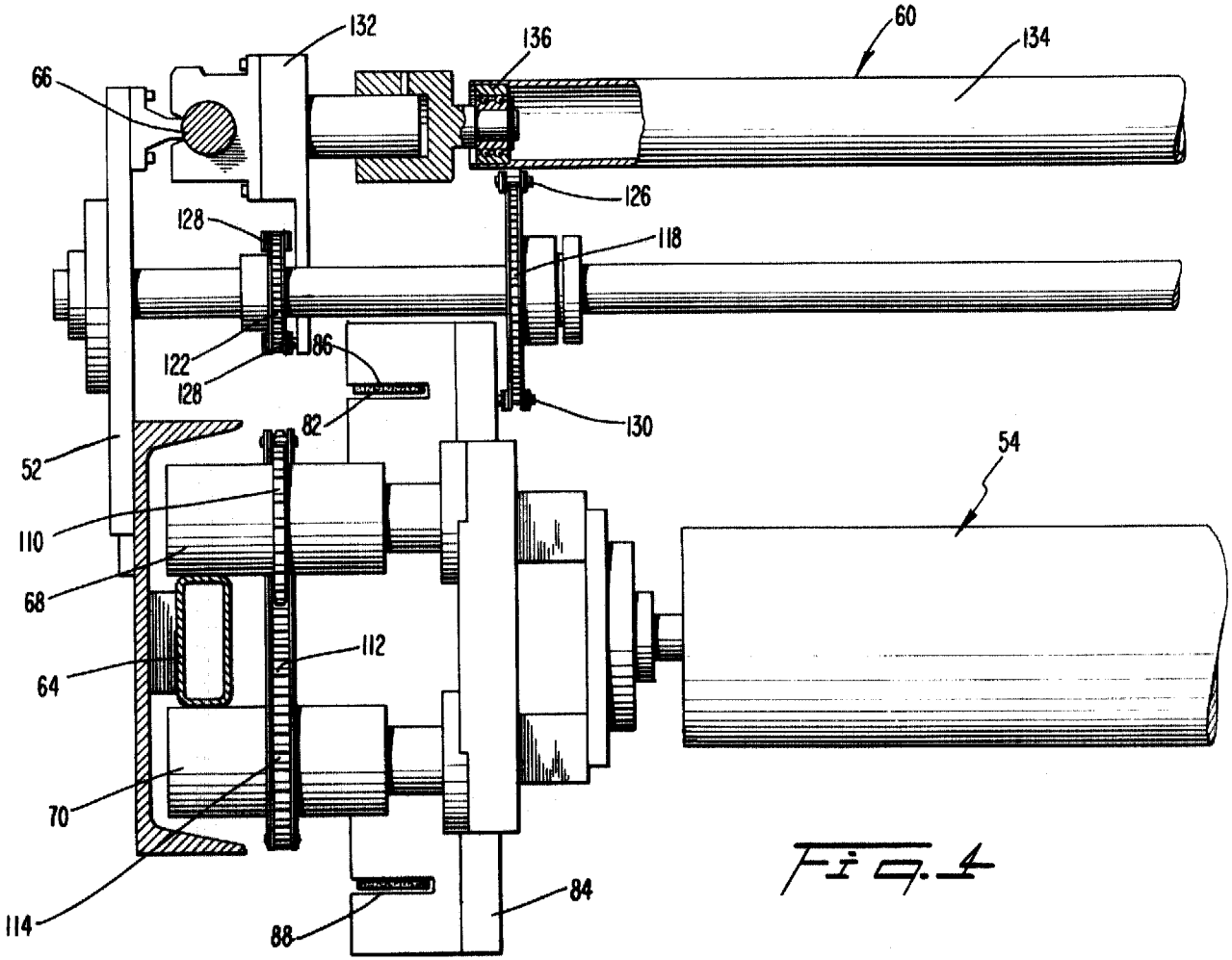
FIG. 4 is an enlarged partial cross-sectional view taken along the line 4—4 of FIG. 3.

The frame 52 has a pair of longitudinal sides extending across the conveyor. Each longitudinal side is provided with a pair guide rails 64, 66 (see FIG. 4). The lower guide rail 64 provides both vertical support and longitudinal guidance for the carriage means 54 during reciprocating movement thereof. The upper guide rail 66 provides vertical support and longitudinal guidance for movement of the compensator means 60. Rotatably mounted rollers 68, 70 at each side of the carriage straddle the corresponding lower guide rail 64 and support the carriage means 54 during reciprocating movement. By using rollers 68, 70, the resistance of the carriage means 54 to movement along the frame 52 is substantially reduced.

The drive means 56 for reciprocating the carriage means 54 (see FIG. 3) includes a suitable conventional electric motor 72 which may be mounted on one longitudinal side of the frame 52. A shaft 74 which is driven by the motor 72 carries a drive pully 76. At the other end of the frame 52 is an idling shaft 78 which carries an idling pully 80 that is in planar alignment with the driving pulley 76. Extending along the entire length of the cross-lapping apparatus 50 between the drive pulley 76 and the driven pulley 80 is a flat drive belt 82. It will be appreciated that the upper run of the drive belt 82 moves in one direction (toward right in FIG. 3) along the frame whereas the lower run of the drive belt 82 moves in the opposite direction (toward left in FIG. 3). Thus, the continuously running belt 82 has portions moving in opposite directions at all times.

One of the carriage means 54 (see FIG. 4) includes a selectively engageable assembly 84 that is operable to selectively engage both upper and lower runs of the belt 82, but only one at a time. The selectively engageable assembly 84 has a pair of grooves 86, 88 each of which receives a corresponding run of the drive belt 82. The upper groove 86 receives the upper run of the drive belt 82; whereas, the lower groove 88 receives the lower run of the drive belt 82. It will be seen that selective engagement between the engageable means 84 with the upper run of the drive belt 82 causes the carriage means 54 to move in one direction; whereas, selective engagement of the means 84 with the lower run of the drive belt 82 will cause the carriage means 54 to move in the opposite direction.

Figure 5:
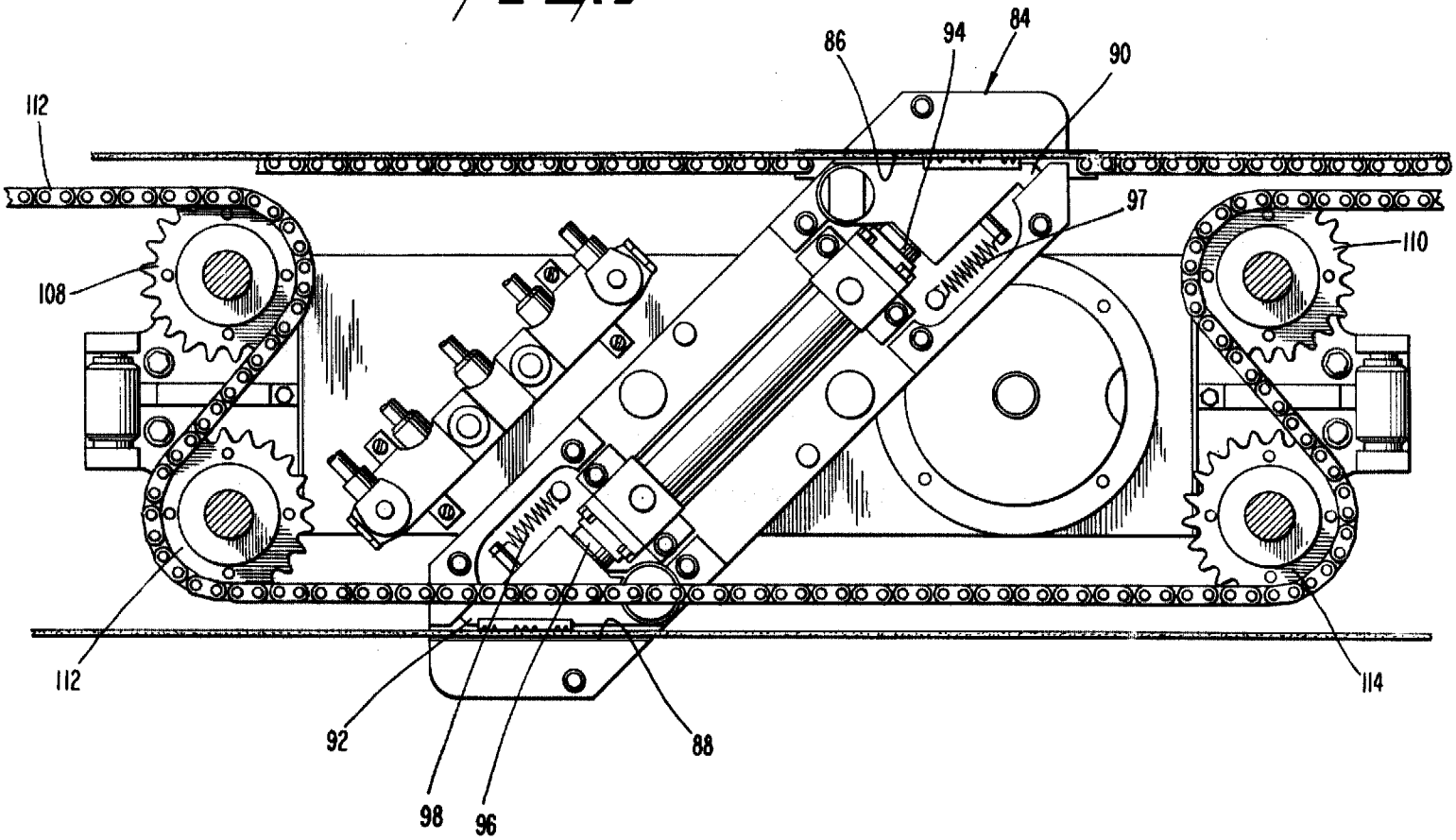
FIG. 5 is an enlarged partial cross-sectional view take along the line 5—5 of FIG. 3.

Turning now to FIG. 5, the apparatus for effecting engagement between the means 84 and the drive belt 82 is illustrated in greater detail. More particularly, each groove 86, 88 has associated therewith a pivotably mounted shoe 90, 92 each of which is actuatable by a double acting, self-centering pneumatic cylinder 94. Each of the shoes 90, 92 is spring biased out of engagement with the drive belt 82. Accordingly, unless the pneumatic cylinder 94 is engaged or pressurized, the respective spring 96, 98 will retract the shoe so as to avoid a driving connection between the belt 82 and the carriage means 54.

The pneumatic cylinder 94 is aligned and oriented at an angle of about 45° to the direction of carriage movement. Moreover, the shoes 90, 92 are pivoted so that relative movement between the drive belt and the carriage tends to drag the shoes out of engagement. These characteristics make possible a very abrupt release and engagement between the shoe and the belt which is necessary for precisely controlled edges.

As noted above (see FIG. 3), only one side of the carriage 54 means is driven. Given the comparatively large width of the frame 52 and the carriage means 54, a mechanism must be provided to assure that both sides of the carriage means 54 advance relative to the frame 52 at the same rate. To accomplish this coordinated movement at both sides, the carriage means 54 includes a pair of parallel transverse bars 100, 102 which provide rigid spacing between the respective sides of the carriage means 54. In addition, positioned within each transverse bar 100, 102 is a corresponding rotatable shaft 104, 106. Each of these rotatable shafts 104, 106 is connected to corresponding sprockets 108, 110 (see FIG. 5), one sprocket being provided at each side of the carriage means 54.

Since the guidance for the carriage means 54 on one side is a mirror image of the guidance means for the other side of the carriage means 54, it will only be necessary to describe one side in detail. In order to coordinate movement, therefore, of both sides of the carriage means 54, a flexible inextensible guide chain 112 is connected at each end to the frame 52. The guide chain 112 is wrapped around the sprockets 108, 110 as well as around a pair of idling sprockets 112, 114. Accordingly, it will be seen that as the carriage means 54 moves along the frame 52, the sprockets 108, 110 are driven by the relative movement between the guide chain and the moveable carriage means 54. This rotational movement is transmitted by the rotatable shafts 104, 106 (see FIG. 3) to the corresponding sprockets on the opposite side of the carriage means 54. Accordingly, the sprockets on the opposite of the carriage cooperate with the corresponding guide chain to give directly driven coordinated movement for both sides of the carriage means 54. With this guidance arrangement, there is essentially no potential that the two sides of the carriage means 54 will get out of synchronization to allow twisting and/or binding of the carriage means 54 relative to the frame 52.

To quickly and efficiently effect direction at the ends of each stroke of the carriage means 54, suitable conventional limit switches can be positioned at each end of the frame 52 to cooperate with a trip member attached to the carriage. Ideally, the limit switches can be positioned under the inertia reversal means 58, 59 so as to be moved therewith in the case of stroke length adjustment. Typically, two limit switches will be provided each end of the frame. The first switch deactivates the corresponding pneumatic cylinder of the engagement means 84 when the switch is engaged by the trip member. At commencement of the return stroke, the trip member releases the seconth limit switch thereby engaging the other pneumatic cylinder to cause engagement of the shoe with the drive belt 82.

To drive the compensating means 60 (see FIG. 3) relative to the frame 52, the frame 52 is provided with a pair of parallel idling shafts 114, 116, one idling shaft being disposed toward each end of the frame 52. Each idling shaft 114, 116 is provided with a pair of chain sprockets which are rigidly connected to the respective shaft for rotation therewith. More particularly, a large sprocket 118, 120 is provided on each shaft 114, 116 with the large sprockets being in general planar alignment with one another. Similarly, a small sprockets 122, 124 is provided on each shaft 114, 116 and these small sprockets also in general planar alignment with one another.

An inextensible flexible timing chain 126 interconnects the two large sprockets 118, 120; similarly a second inextensible flexible timing chain 128 interconnects the two smaller sprockets 122, 124. At this junction it should be noted that the diameter ratio between the large sprockets 118, 120 and the small sprockets 122, 124 is 2:1. It has been found that with this ratio movement of the compensating means 60 is properly coordinated with movement of the carriage means 54 so as to maintain a uniform tension in the tow being deposited as a cross-lapped batting.

Actual coordination of movement between the compensator means 60 and the carriage means 54, is accomplished by attaching the fist timing chain 126 at each end 130 to the selectively engageable means 84 of the carriage means 54. Similarly, the second timing chain 128 is attached at each end to a guide block 132 carried at the end of the compensating means 60 and slidably mounted on the upper guide rail 66. Thus, movement of the carriage means 54 causes a coordinated movement of the compensating means 60 at a ratio of 2:1.

It should also be noted at this point that the compensating means 60 includes a rotatable cylinder 134 which is mounted on suitable conventional bearings 136 at each end to give essentially no resistance to movement of the tow therearound.

The carriage means 54 (see FIG. 3) includes a suitable conventional electric motor 136 positioned on the side opposite to the engageable means 84. The motor 136 is controlled and connected with a first roll 138 by means of a drive belt 142. This driving roll 138 extends laterally across the carriage means 54 between the sides thereof. The tow passes through a nip defined between the driving roll 138 and a parallel closely positioned driven roll 140. Accordingly, the rolls 138, 140 control the velocity of the tow as it passes therebetween.

From the foregoing description it will be apparent that the carriage means 54 is constructed to be as light as possible and still perform the intended functions. As a result, the carriage has a very low inertion which facilitates direction reversals which occur at the ends of each stroke.

Figure 6:
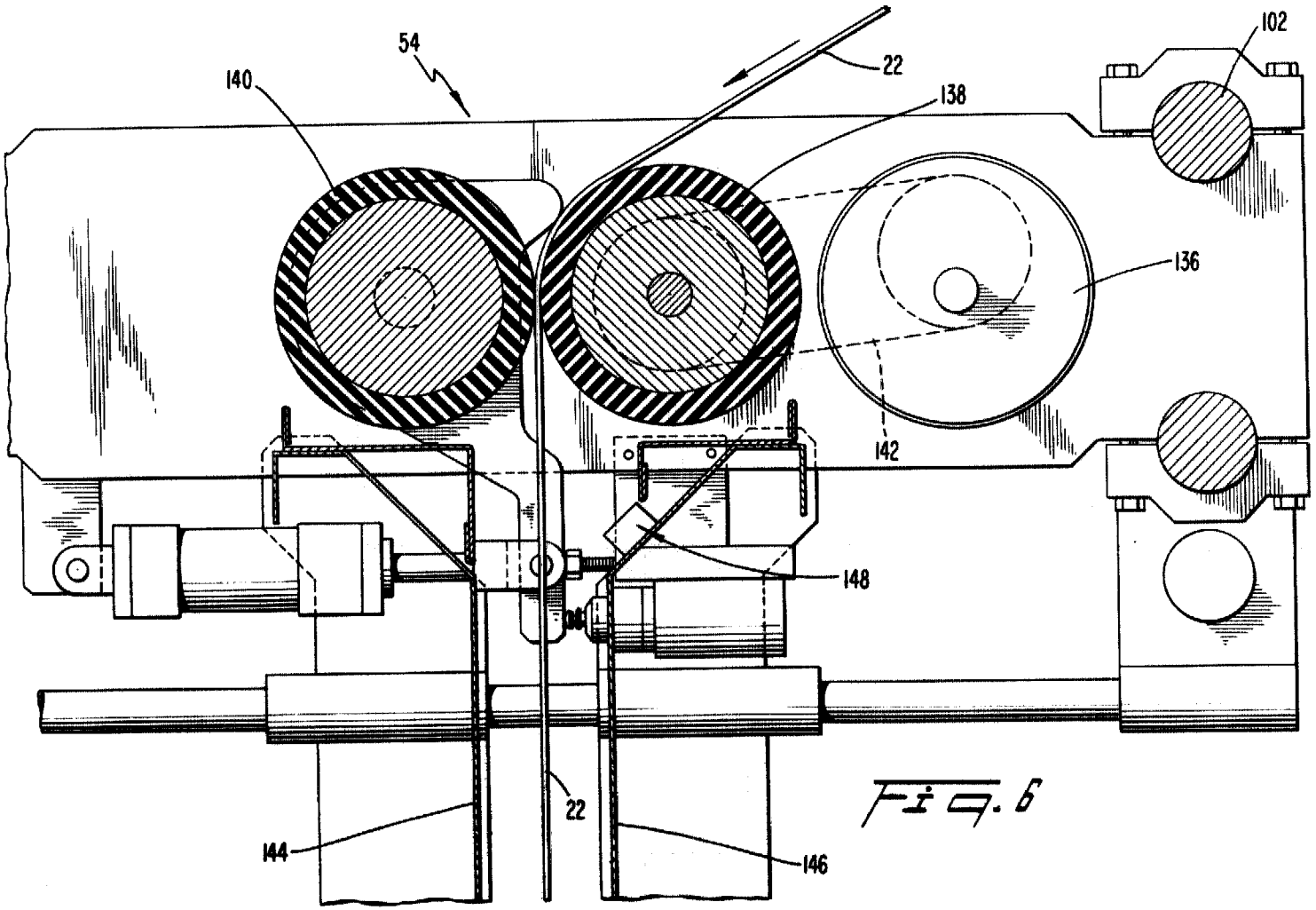
FIG. 6 is an enlarged partial cross-sectional view taken along the line 6—6 of FIG. 3.

Turning to FIG. 6, the rolls 138, 140 are illustrated in greater detail. The rolls 138, 140 are preferably fabricated from steel or any other suitable metal which does not generate static electricity in the tow 22 passing therebetween. The use of steel as the material for the rolls 138, 140 has been found to be highly desirable for two reasons. Firstly, the steel has enabled the use of substantially higher denier tows than was heretofore possible. For example, a total denier of 450,000 for the tow is acceptable. Secondly, the use of the steel rolls has reduced the generation of static electricity in the continuous filaments of the tow 22. Static electricity in the tow makes it more difficult to lay the tow in uniform layers and has a substantially adverse effect on the ability to control or otherwise regulate the density in the resulting batting.

As the tow 22 leaves the rolls 138, 140, the tow passes between a pair guide plates 144, 146 which are mounted on the carriage means 54 directly beneath the rolls 138, 140 but above the conveyor means. These guide plates 144, 146 define a channel through which the tow passes and protect the tow from miscellaneous air currents during reciprocating movement of the carriage means 54. Such random air currents might otherwise interfere with the precision laydown possible with the process.

In addition, one or both of the guide plates 144, 146 may be provided with a static eliminator 148. The static eliminator 148 interacts with the tow 22 to further eliminate any static electricity which may have been generated before the tow reaches the carriage means 54. Accordingly, the static eliminator 148 also enhances the ability to laydown in cross-lapped fashion a batting having a precisely controlled density.

Figure 6A:
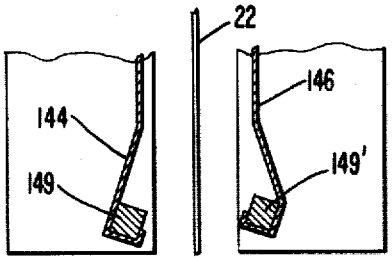
Figure 6B:
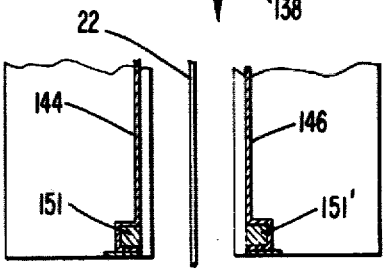

One or more additional static eliminators may be provided at the bottom of the plates 144, 146. For example, (see FIG. 6*a*) static eliminators 149, 149' may be located at the bottom of the plates 144, 146, respectively. The eliminator 149 is directed vertically downwardly whereas the eliminator 149' is directed vertically upwardly. In another embodiment (see FIG. 6*b*), a pair of static eliminators 151, 151' are arranged oppositely from one another on a corresponding one of the plates 144, 146 so as to generate a different static eliminating force field.

The coordinated movement of the carriage means 54 and the compensating means 60 is depicted more clearly in FIGS. 7*a* through 7*d*. Rolls 138, 140 are moving laterally at twice the speed of compensating means 60. The tow 22 is vertically supported only by the compensator means 60 and has a substantial horizontal length which is unsupported.

Figure 7A:
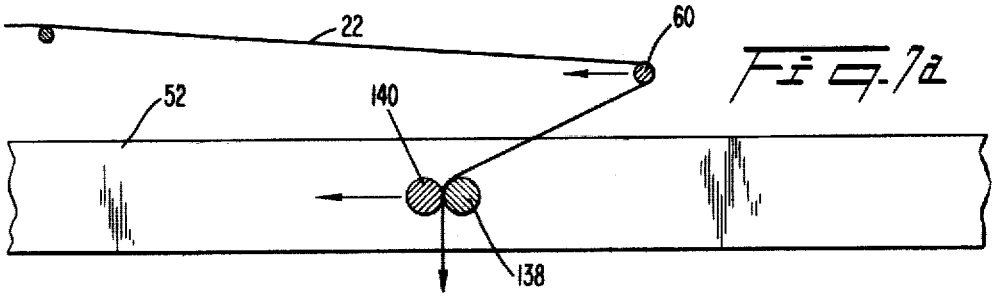
Figure 7B:
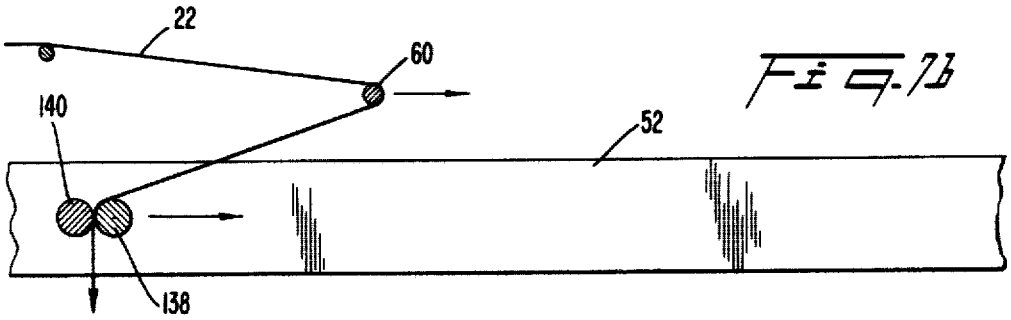
Figure 7C:
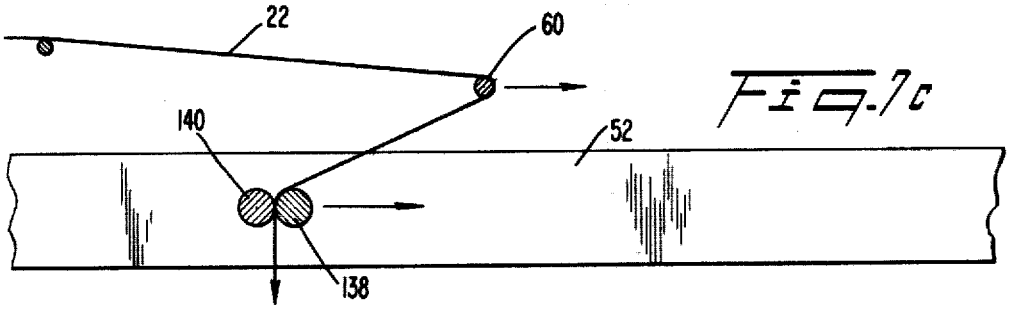
Figure 7D:
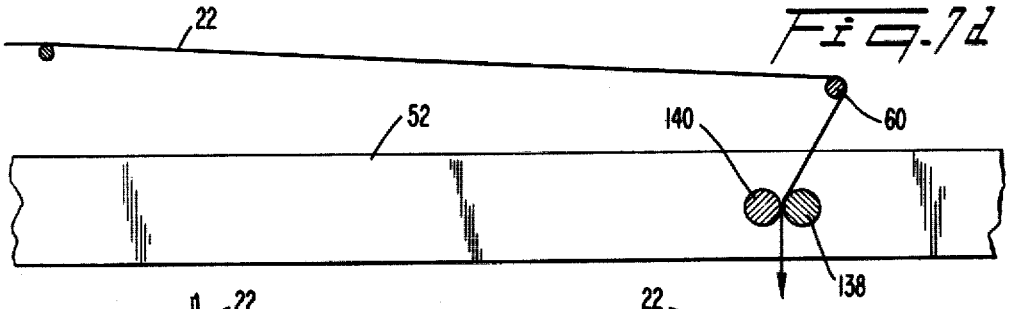

As movement of the carriage means continues, the compensator means 60 and the carriage rolls 138, 140 move to the positions illustrated in FIG. 7*b*. Throughout this movement, the tension in the tow 22 is maintained substantially constant and the tow delivery rate to the receiving conveyor is also uniform. In the position shown in FIG. 7*b*, the carriage means is at the end of a stroke and undergoes a directional reversal and begins to move towards the position schematically depicted in FIG. 7*c*. With continued movement, the carriage means moves to the position shown in FIG. 7*d* where movement reversal at the opposite end of the frame 52 is encountered at the end of this stroke so that the rolls 138, 140 and the compensator means 60 move in the directions illustrated. Throughout the above described sequence, the compensator means 60 takes up slack in the tow to mantain tension therein.

Turning now to FIG. 8, an alternate drive mechanism is illustrated which provides a potentially greater delivery speed than is available with the continuously driven drive belt in the embodiment of FIG. 3 and, therefore, an improved production rate for batting. More particularly, a reversible electric motor 160 is mounted to the frame 52. The reversible motor drives the shaft 74 which is now provided with a driving sprocket 162 rather than a pulley. In similar fashion the idling shaft 78 is provided with a driven sprocket 164 which is in general planar alignment with the driving sprocket 162. Extending between the driven sprocket and the one end of the carriage means 54 is a flexible inextensible drive chain 166. This drive chain may be attached at one end to one side of the carriage means 54 (see FIG. 9). The other end passes around an idling sprocket 164 and attaches to the other side of carriage means 54.

With this direct drive arrangement, reversal of the motor 160 (see FIG. 8) causes the carriage means 54 to move in opposite directions. By continuing use of the inertia reversal means 58, 59 at each end of the stroke, kinetic energy of the carriage movement 54 is utilized and stored as potential energy to initiate movement of the carriage means in the opposite direction. With such an arrangement, the required torque for the motor 160 is substantially reduced relative to the torque size necessary for a motor that can both stop and start movement of the carriage means 54 relative to the frame 52 in a necessarily brief period.

Another particular advantage of this directly driven embodiment of the cross-lapping apparatus resides in the fact that the power supplied to the reversible motor may be controlled in such a manner as to provide a controlled density profile transversely of the cross-lapped batting. More particularly, by controlling speed of the motor, an appropriately select velocity of traversal for the carriage means 54 will result. The rate at which tow is deposited on the underlying conveyor means 58 is a function of that transversal velocity. For example, allowing the carriage 54 to move at a comparative slow velocity while delivering tow at a uniform rate will permit a larger quantity of filament material to pile up on the batting at that particular location. Conversely, by accelerating movement of the carriage means 54 while delivering the tow at a uniform rate, the density of the material forming the batting will be reduced. Accordingly, by appropriately controlling the motor 160 a desired density gradation is created laterally with respect to the batting. In this manner, it is possible to provide whatever predetermined density variation may be necessary or desired.

It should now be apparent that there has been provided in accordance with the present invention a new and improved cross-lapping apparatus which overcomes problems of the type discussed and which possesses numerous significant advantages. Moreover, it will apparent to those skilled in the art that numerous modifications, variations, substitution and equivalents exist for features of the invention which do not materially depart from the scope thereof. Accordingly, it is expressly intended that all such modifications, variations, substitutions and equivalents which fall within the spirit and scope of the invention as defined by the appended claims be embraced thereby.

What is claimed is:

1. Apparatus for cross-lapping a previously spread high denier tow of continuous filaments to create a controlled edge and controlled density batting therefrom, comprising: a frame; conveyor means under the frame for receiving the spread tow in the form of a batting; carriage means mounted for direct drive reciprocating movement on the frame transversely of the conveyor means and operable to deposit the spread tow on the conveyor means at a substantially constant rate; reversible motor means mounted on the frame, connected with the carriage means, and operable to reciprocate the carriage means relative to the conveyor means; and means for controlling the speed of said motor whereby a pre-selected lateral density gradation of the batting may be obtained as well as obtaining a precision batting edge.

2. The apparatus of claim 1 wherein: the carriage means includes a pair of counter rotating rollers which extend transversely of the carriage means and define a nip through which the spread tow passes, at least one roller being positively driven at a uniform rate so as to deposit the spread tow on the conveyor means at a substantially constant rate.

3. The apparatus of claim 2 wherein: each roller of the pair is metal so as to eleminate lapping by individual filaments of the spread tow and to substantially avoid generation of static electricity tow.

4. The apparatus of claim 2 wherein the conveyor means has two ends, one end being located beneath the frame and being elevated above the second end located remotely from the frame so that upper surface of the conveyor means is essentially a uniform distance from the nip of the rollers.

5. The apparatus of claim 1 further including: compensating means mounted above the carriage means having idling rollers which engage the spread tow, and operable to reciprocate at a rate coordinated with the reciprocation of the carriage means such that the carriage means deposits the spread tow at a pre-selected rate.

* * * * *